US006670774B2

(12) United States Patent
Son et al.

(10) Patent No.: US 6,670,774 B2
(45) Date of Patent: Dec. 30, 2003

(54) PLASMA DISPLAY PANEL DRIVING METHOD AND APPARATUS CAPABLE OF REALIZING RESET STABILIZATION

(75) Inventors: Jin-Boo Son, Busan (KR); Jin-Sung Kim, Anyang (KR)

(73) Assignee: Samsung SDI Co., Ltd., Suwon (KR)

( * ) Notice: Subject to any disclaimer, the term of this patent is extended or adjusted under 35 U.S.C. 154(b) by 64 days.

(21) Appl. No.: 10/106,069

(22) Filed: Mar. 27, 2002

(65) Prior Publication Data

US 2002/0171369 A1 Nov. 21, 2002

(30) Foreign Application Priority Data

May 16, 2001 (KR) ..... 2001-026780

(51) Int. Cl.[7] ..... G09G 3/10
(52) U.S. Cl. ..... 315/169.4; 345/60
(58) Field of Search ..... 315/169.1, 169.4; 345/60, 67, 68

(56) References Cited

U.S. PATENT DOCUMENTS 5,877,734 A * 3/1999 Amemiya ..... 345/60
6,037,916 A * 3/2000 Amemiya ..... 345/60
6,181,305 B1 * 1/2001 Nguyen et al. ..... 345/60
6,465,970 B2 * 10/2002 Nagakubo et al. ..... 315/169.4
2002/0054001 A1 * 5/2002 Awamoto ..... 345/60

* cited by examiner

*Primary Examiner*—Don Wong
*Assistant Examiner*—Thuy Vinh Tran
(74) *Attorney, Agent, or Firm*—McGuireWoods LLP

(57) ABSTRACT

A method and apparatus for driving a plasma display panel (PDP) by which reset stabilization can be achieved are provided. In the method for driving a PDP, successive field periods, each including a reset period for initializing the state of respective cells, an address period for selectively discriminating cells to be turned on from cells not to be turned on and for performing an addressing operation, and a sustain period for discharging the addressed cells are performed. A reset stabilization period for inducing discharging in a discharge space between cells is additionally performed before the reset period if a rest period having a predetermined time duration is present between the sustain period of a preceding field and the reset period of the field. Therefore, the reset operation can be performed in a state where discharge cells between electrodes are sufficiently primed.

15 Claims, 7 Drawing Sheets

PLASMA DISPLAY PANEL DRIVING METHOD AND APPARATUS CAPABLE OF REALIZING RESET STABILIZATION

BACKGROUND OF THE INVENTION

1. Field of the Invention

The present invention relates to a method and apparatus for driving plasma display panels (PDPs) used in television receivers or computer monitors to display a picture, and more particularly, to a method and apparatus for driving PDPs that can realize reset stabilization.

2. Description of the Related Art

FIG. 1 is a partial perspective view of an AC type PDP. As shown in FIG. 1, pairs of a scan electrode 4 and a sustain electrode 5 are formed to be parallel to one another on a first glass substrate 1 and are covered with a dielectric layer 2 and a protective layer 3. A plurality of address electrodes 8 are formed on a second glass substrate 6 and are covered with an insulator layer 7. A plurality of barrier ribs 9 are formed on the insulator layer 7 to be parallel to and between the address electrodes 8. A fluorescent layer 10 is formed on the surface of the insulator layer 7 and the sidewalls of the barrier ribs 9. The first and second glass substrates 1 and 6 are disposed to face each other with a discharge space 11 therebetween so that the scan electrodes 4 and the sustain electrodes 5 are orthogonal to the address electrodes 8. The discharge space 11 at each intersection between an address electrode 8 and a pair of a scan electrode 4 and a sustain electrode 5 forms a discharge cell 12.

FIG. 2 shows an electrode array in a panel. The electrodes form a matrix having m columns and n rows. Address electrodes A1 through Am are arranged in columns, and scan electrodes SCN1 through SCNn, and sustain electrodes SUS1 through SUSn, are arranged in rows. A discharge cell indicated by the hatched rectangle in FIG. 2 corresponds to the discharge cell 12 of FIG. 1.

FIG. 3 is a general timing diagram for driving a panel. In this driving method, one frame period consists of 8 subfields for 256 gray scales. Each subfield consists of a reset period, an address period, and a sustain period.

In general, the panel driving timing is divided into a reset (initialization) period, an address period, and a sustain period. For the reset period, the charge state in each cell is initialized so as to smoothly perform an addressing operation in each cell. For the address period, cells to be turned on and cells not to be turned on in a panel are selected by scan pulses sequentially applied to the scan electrodes and address pulses applied to the address electrodes. Thereafter, the address discharging is carried out on the cells to be turned on to accumulate wall charges therein. For the sustain period, sustain discharging is performed on the cells, which are addressed by the address discharging, by applying sustain discharge pulses alternately to the scan and sustain electrodes, to display a picture. Also for the reset period, negative wall charges are accumulated on the surface of the protective layer covering the scan electrodes, and positive wall charges are accumulated on the surface of the insulator layer covering the address electrodes and on the surface of the protective layer covering the sustain electrodes. The amount of wall charges accumulated on each electrode is adjusted to be suitable for addressing in the addressing period.

One frame of a panel corresponds to a time of 16.67 msec ranging from the reset period of the first subfield to the sustain period of the last subfield. After one frame passes, the reset period of the first subfield of a next frame is started. After a sustain operation in the last subfield of the current frame and before a reset operation in the first subfield of the next frame, a rest period exists. If the rest period is too long, a reset discharge operation in the reset period of the first subfield of the next frame is affected. Therefore, a short rest period is advantageous to ensure reset stabilization in a next frame.

In a conventional method of driving a panel, during the rest period between the sustain period of a preceding subfield and the reset period of the following subfield, cell discharging does not occur so that a priming effect is considerably reduced. Accordingly, the reset operation in the following subfield is performed with the reduced priming effect so that the reset discharge can not be performed smoothly.

SUMMARY OF THE INVENTION

To solve the above-described problem, it is an object of the present invention to provide a method and apparatus for driving a plasma display panel (PDP) by which reset stabilization can be achieved even when there is a rest period before a reset period in driving the PDP.

To achieve the object of the present invention, there is provided a method for driving a PDP in which successive field periods, each including a reset period for initializing the state of respective cells, an address period for selectively discriminating cells to be turned on from cells not to be turned on and for performing an addressing operation, and a sustain period for discharging the addressed cells are performed, and a reset stabilization period for inducing discharging in a discharge space between cells is additionally performed before the reset period if a rest period having a predetermined time duration is present between the sustain period of a preceding field and the reset period of the field.

In one embodiment, the present invention provides a method of driving a PDP for displaying a picture by causing discharging in a discharge space between electrodes, in which if there is a time interval during which no discharging occurs in the discharge space before a reset period, a reset stabilization period is additionally performed before the reset period by applying a predetermined voltage to the electrodes to cause discharging between the electrodes.

In another embodiment, the present invention provides a method of driving a PDP in which successive field periods, each including a reset period for initializing the state of respective cells, an address period for selectively discriminating cells to be turned on from cells not to be turned on and for performing an addressing operation, and a sustain period for discharging the addressed cells are performed, and a rest period in which no discharge in cells occurs for a predetermined of time is positioned between the reset period and the address period, between the address period and the sustain period, or in the middle of the sustain period.

To achieve the object of the present invention, there is also provided a PDP driving apparatus comprising: a reset signal generator for generating a reset signal initializing the state of respective cells; an address signal generator for generating an address signal for selectively discriminating cells to be turned on from cells to be turned off and for performing an addressing operation; and a sustain signal generator for generating a sustain signal discharging the cells addressed by the address signal generator, wherein if cell discharging does not occur for a predetermined time interval before application of the reset signal, the reset signal generator generates a reset stabilization signal to cause discharging to occur in the cells prior to the generation of the reset signal.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Figure 1:
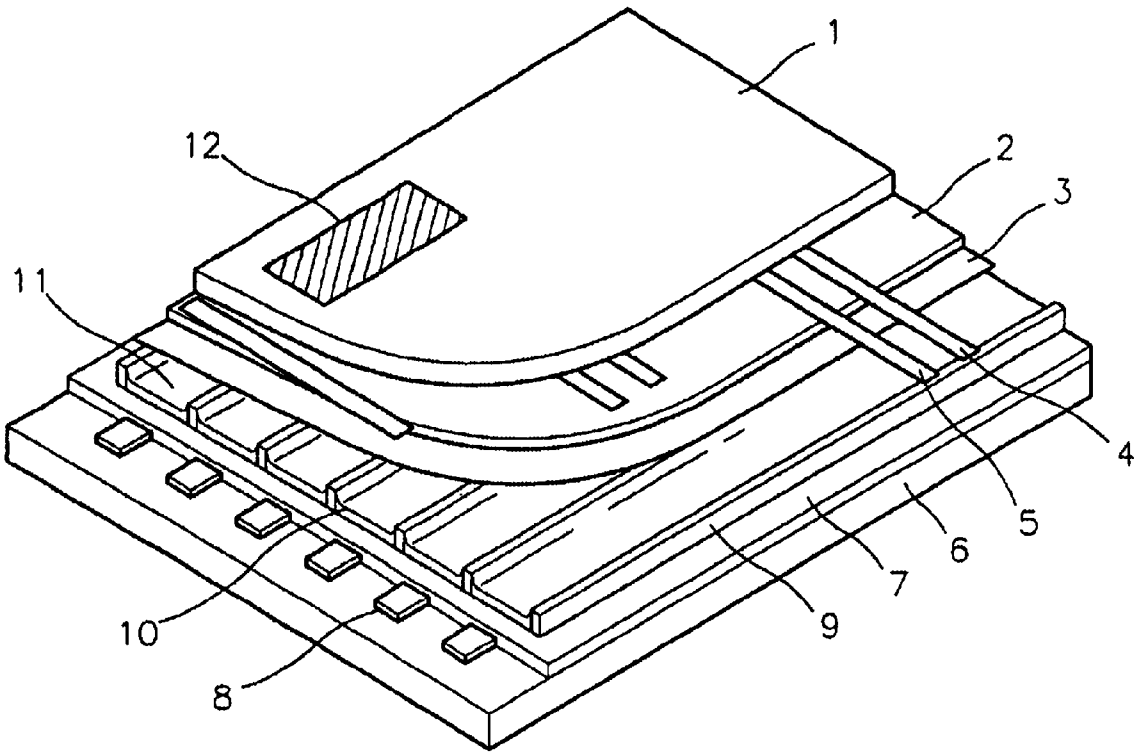
FIG. 1 (PRIOR ART)
FIG. 1 is a partial perspective view of an AC type plasma display panel (PDP)
Figure 2:
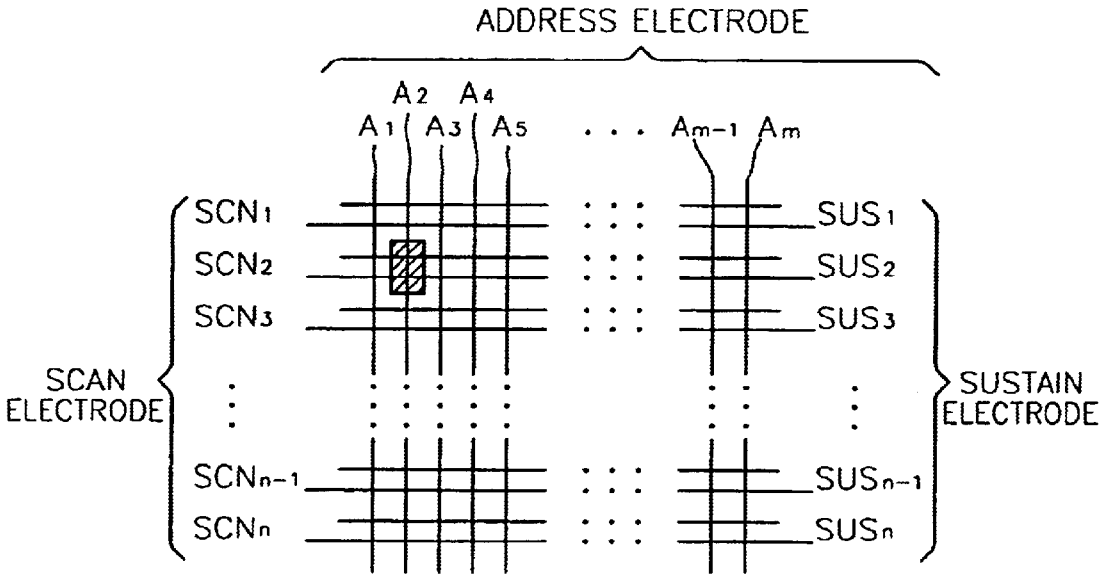
FIG. 2 (PRIOR ART)
FIG. 2 shows an electrode array in a panel.
Figure 3:
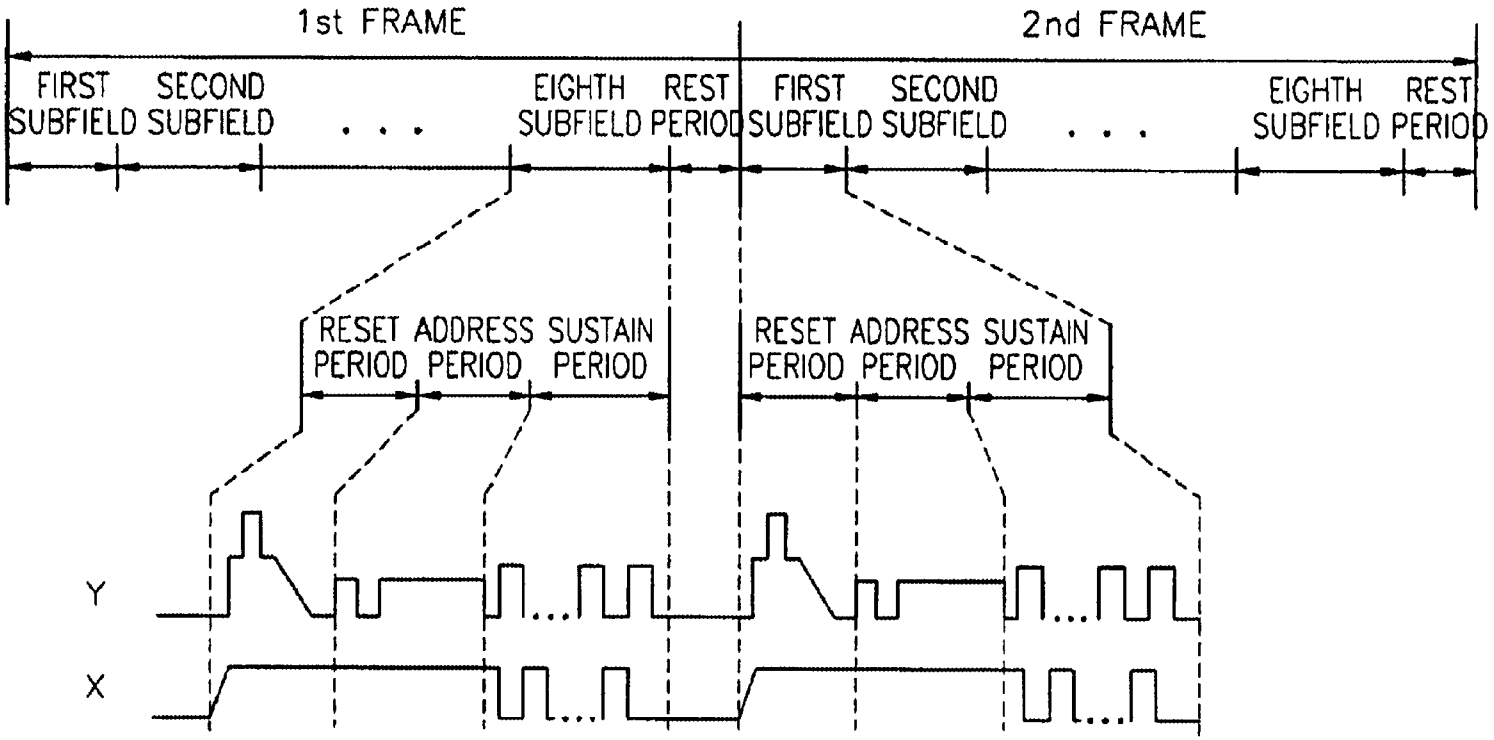
FIG. 3 (PRIOR ART)
FIG. 3 is a general timing diagram for driving a panel.
Figure 4A:
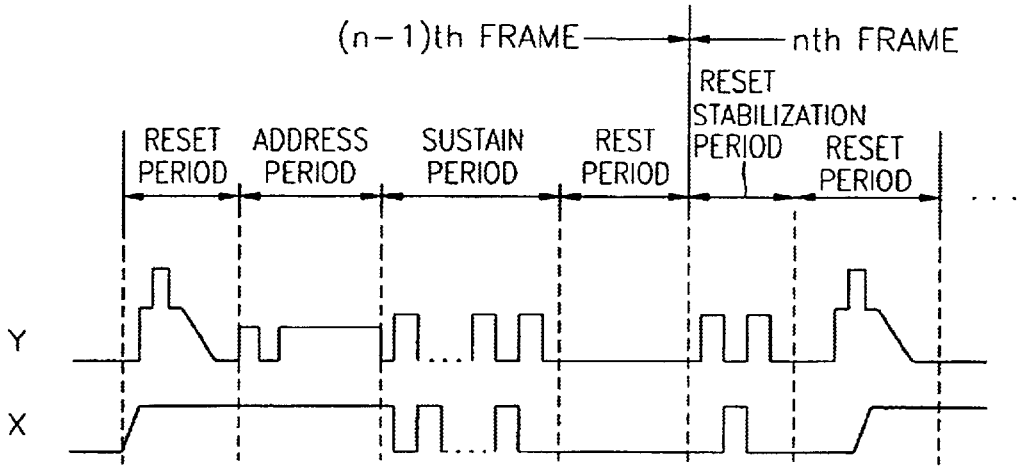
FIGS. 4A and 4B are timing diagrams illustrating preferred embodiments of a PDP driving method according to the present invention.
Figure 4B:
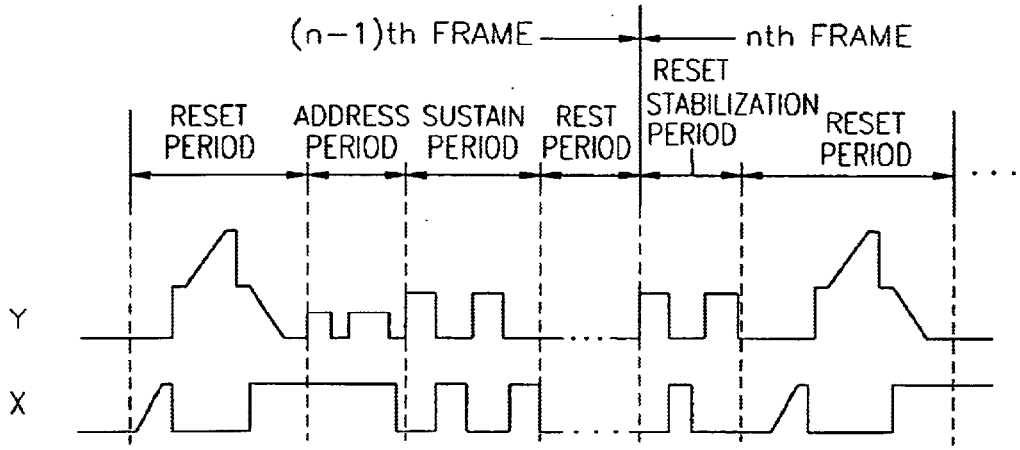

Timing diagrams illustrating preferred embodiments of a PDP driving method according to the present invention are shown in FIGS. 4A and 4B. One frame consists of a plurality of subfields each being divided into a reset period, an address period, and a sustain period. Although the present embodiments are described with reference to a frame including subfields, it will be appreciated by those skilled in the art that the present invention is not limited to this frame structure.

The reset period is for controlling the distribution of wall charges in the respective sustain electrodes and scan electrodes by forming an appropriate number of wall charges with an appropriate polarity to enable a smooth address operation in the address period. In other words, in the reset period, the state of wall charges in cells is adjusted to enable address discharging in the address period.

The rest period is generally interposed between the last subfield of a (n−1)th frame and the first subfield of an (n)th frame. For the subfields other than the first subfield of the (n)th frame, the reset period is temporally close to the sustain period of the preceding subfield so that the priming effect by sustain discharging in the preceding subfield is exerted on the reset period of the current subfield, thereby enabling a normal reset operation in the current subfield. However, a reset discharging operation is likely to be improperly performed in the first subfield of the (n)th frame because a long rest period, during which the voltage applied to the electrodes of a panel is maintained constant and discharging does not occur, following a last sustain discharging in the (n−1)th frame dilutes the priming effect in a discharge space.

Figure 7:
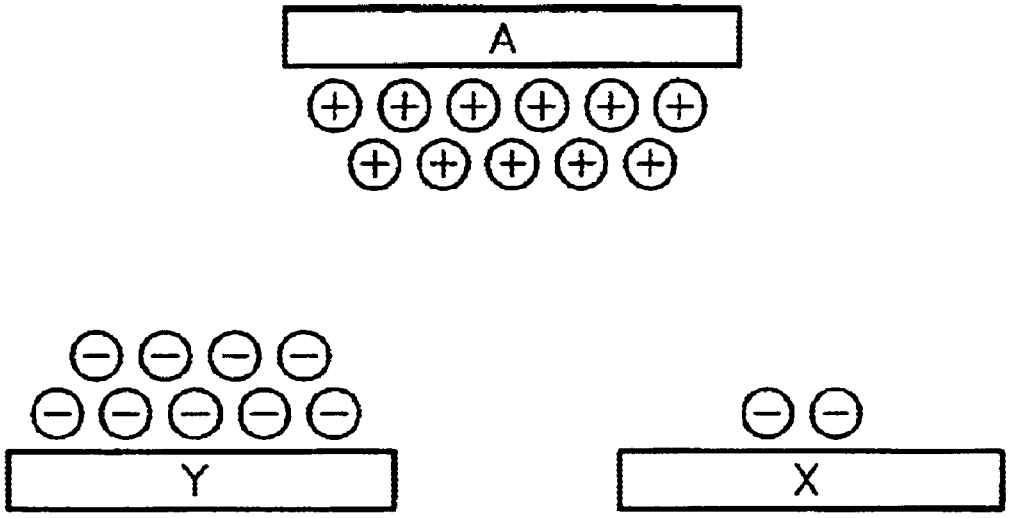
FIG. 7 is a diagram showing the state of wall charges in a discharge cell resulting from a normal reset operation in a reset period.

FIG. 7 is a diagram illustrating the state of wall charges formed in a discharge cell when a normal reset operation occurs in a reset period. A large number of negative charges are accumulated on a scan electrode Y and a large number of positive charges are accumulated on an address electrode A. The number of charges accumulated on the scan electrode Y and the address electrode A should be sufficient so as to generate a wall voltage equal to or greater than a voltage at which address discharging is caused to occur upon the application of an address voltage to the electrodes. At this time, a small number of negative charges or an appropriate number of positive charges may be accumulated on a sustain electrode X. When the priming effect is weakened by a long rest period, the state of charges shown in FIG. 7 may be not established by the reset operation. In this case, a problem in an addressing operation occurs.

FIGS. 4A and 4B are timing diagrams illustrating preferred embodiments of a PDP driving method according to the present invention. In the preferred embodiments of FIGS. 4A and 4B, a reset stabilization period is provided immediately before the reset period in the first subfield of some frames to cause sustain discharging or similar discharging for stabilization of the reset operation in the first subfield of the frames. In other words, a reset stabilization period of applying a predetermined number of discharge pulses is performed between the rest period of the (n−1)th frame and the first reset period of the (n)th frame, and preferably immediately before the reset period of the (n)th frame. Preferably, a portion of the reset period is used as the reset stabilization period. The number of discharge pulses applied in the reset stabilization period may vary depending on the duration of the rest period. In particular, if the rest period is long, a relatively large number of discharge pulses are applied in the reset stabilization period. If the rest period is short, less discharge pulses are required during the reset stabilization period to sustain the priming effect. Alternatively, when the rest period is long, the width of discharge pulses applied for the reset stabilization may be increased wider than sustain discharge pulses or a voltage may be increased to obtain a sufficient priming effect. Usually, one to three discharge pulses (i.e., discharging one to three times) are enough to achieve the reset stabilization. The width and period of discharge pulses and the voltage level applied in the reset stabilization period may be the same as or may slightly differ from the width, period, and voltage level of sustain discharge pulses applied in the sustain period.

In the reset stabilization period, discharge may be caused to occur in all cells or in only the cells in which a sustain discharge occurred in the last subfield of the (n−1)th frame. Although it is illustrated in FIGS. 4A and 4B that discharging is caused to occur in discharge spaces between the scan and sustain electrodes, a structure may be designed such that discharging occurs in discharge spaces between the scan and address electrodes or between the scan, sustain, and address electrodes.

Even through a few discharge pulses are applied in the reset stabilization period, the brightness of a screen is little affected by the application of the discharge pulses. However, it is preferable that the number of sustain pulses applied in the sustain period of the last subfield of the (n−1)th frame varied in consideration of the number of discharge pulses to be applied in the reset stabilization period.

Operations performed during a reset stabilization period and reset period will be described with reference to FIGS. 4A and 4B.

In an embodiment, referring to FIG. 4A, a ramp pulse, which is a monotonic increasing pulse, is applied to all sustain electrodes X in a reset period. In a discharge cell where sustain discharging has occurred, a voltage between the surface of the protective layer on a scan electrode and the surface of the protective layer on a sustain electrode becomes the sum of a wall voltage formed by negative wall charges on the surface of the protective layer on the scan electrode, a wall voltage formed by positive wall charges on the surface of the protective layer on the sustain electrode, which are present at the end of the sustain period, and a ramp voltage, which is the voltage of the ramp pulse. As a result, a weak erasing discharging occurs between the sustain electrode and the scan electrode in the discharge cell where sustain discharging has occurred, and the negative wall charges on the surface of the protective layer on the scan electrode and the positive wall charges on the surface of the protective layer on the sustain electrode become weak so that the sustain discharging stops. For these erasing operations, not only can a ramp pulse be applied as the erasing pulse for the sustain electrode X, but the erasing pulse can also be applied as a pulse having a narrower width than a sustain discharge pulse, a pulse having a wider width than a sustain discharge pulse and a voltage level lower than a sustain discharge voltage, or a pulse having a logarithmic waveform.

In describing the waveform of a pulse applied to the scan electrode Y in the reset period, after the ramp pulse is applied to the sustain electrode X, a square reset pulse is applied in an early stage of the reset period and a linearly decreasing ramp pulse is applied in the latter stage of the reset period to the scan electrode Y. Meanwhile, a constant level of voltage is applied to the sustain electrode X, preferably with a level equal to or greater than the sustain discharge voltage in the reset period and with a voltage level greater than the sustain discharge voltage in the address period. A zero voltage is applied to address electrodes in the reset period.

In another embodiment, referring to FIG. 4B, a linearly increasing ramp voltage is applied to all sustain electrodes X. In a discharge cell where sustain discharging has occurred, a voltage between the surface of the protective layer on a scan electrode and the surface of the protective layer on a sustain electrode becomes the sum of a wall voltage formed by negative wall charges on the surface of the protective layer on the scan electrode, a wall voltage formed by positive wall charges on the surface of the protective layer on the sustain electrode, which are present at the end of the sustain period, and a ramp voltage, which is the voltage of the ramp pulse. As a result, a weak erasing discharging occurs between the sustain electrode and the scan electrode, as described above.

In describing the waveform of a pulse applied to the scan electrode Y in the reset period, all address electrodes and sustain electrodes are maintained at 0V in an early stage of the reset period. A ramp voltage starting from a voltage no greater than a discharge start voltage with respect to the sustain electrodes X and slowly increasing toward a voltage greater than the discharge start voltage is applied to all scan electrodes Y. While the ramp voltage is increasing, a first weak reset discharge occurs from a scan electrode toward an address electrode and a sustain electrode in all discharge cells. As a result, negative wall charges are accumulated on the surface of the protective layer on each scan electrode. Simultaneously, positive wall charges are accumulated on the surface of an insulator layer on each address electrode and on the surface of the protective layer on each sustain electrode.

During the latter stage of the reset period, all the sustain electrodes are maintained at a constant voltage. A ramp voltage starting from a voltage no greater than a discharge start voltage with respect to the sustain electrodes and slowly decreasing toward a zero voltage greater than the discharge start voltage is applied to all the scan electrodes. While the ramp voltage is decreasing, a second weak reset discharge occurs from a sustain electrode toward a scan electrode in all the discharge cells. As a result, the negative wall charges of the surface of the protective layer on each scan electrode and the positive wall charges of the surface of the protective layer on each sustain electrode are decreased. In addition, a weak discharge occurs between an address electrode and a scan electrode, and thus the positive wall charges of the surface of the insulator layer on each address electrode are adjusted to a value suitable for an addressing operation. A reset operation in the reset period is completed in the manner described above and is followed by an address period.

The preferred embodiments of the present invention described above should not be construed as restricting the waveforms of signals applied to the respective electrodes in the reset period. Any waveform capable of reset discharging in the discharge space of panels to satisfy the addressing conditions can be applied in the reset period.

According to the preferred embodiments of the present invention, reset stabilization is performed after a rest period in which no sustain discharging occurs and before a reset period so that a reset operation in a subfield following the rest period can be performed in a state where discharge cells are sufficiently primed, thereby stabilizing the reset operation. In other words, the reset operation performed immediately after the rest period can be stabilized by sufficiently priming the discharge space.

Figure 5:
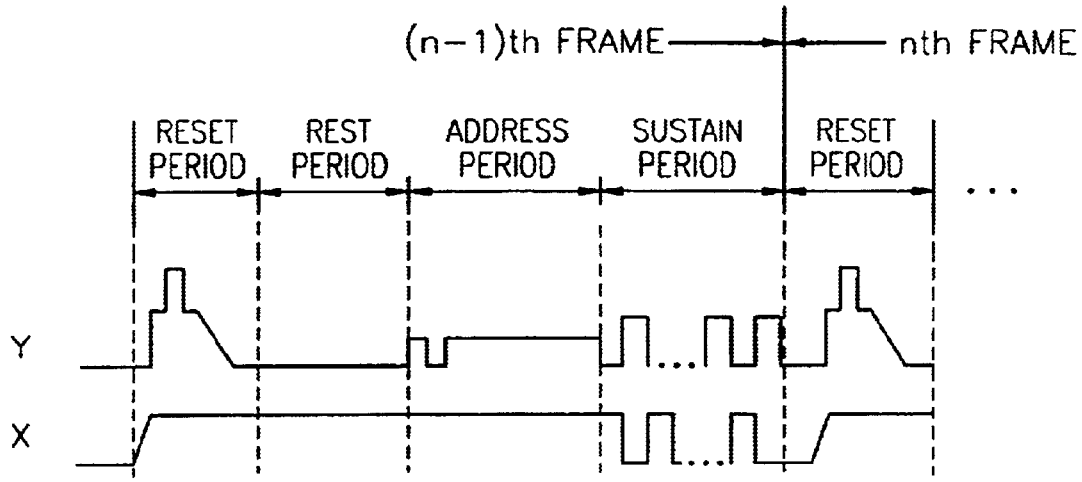
FIG. 5 is a timing diagram illustrating another preferred embodiment of the PDP driving method according to the present invention.

FIG. 5 is a timing diagram of another preferred embodiment of the PDP driving method according to the present invention. In FIG. 5, a rest period for the last subfield of the (n−1)th frame is positioned between the reset period and address period of the last subfield. In other words, the sustain period for sustain discharging in the last subfield of the (n−1)th frame is positioned immediately before the reset period of the first subfield of the (n)th frame. Alternatively, the rest period may be positioned between the address period and the sustain period in the last subfield of the (n−1)th frame, or it may be positioned in the sustain period or in the address period of the last subfield of the (n−1)th frame. In addition, the rest period may be divided and then distributed in the address period and/or the sustain period. In the preferred embodiment illustrated in FIG. 5, a cell discharging operation is performed immediately before the reset period of a next frame by not placing the rest period of the last subfield of the preceding frame immediately before the reset period of the first subfield of the next frame, thereby realizing reset stabilization in the next frame.

Figure 6:
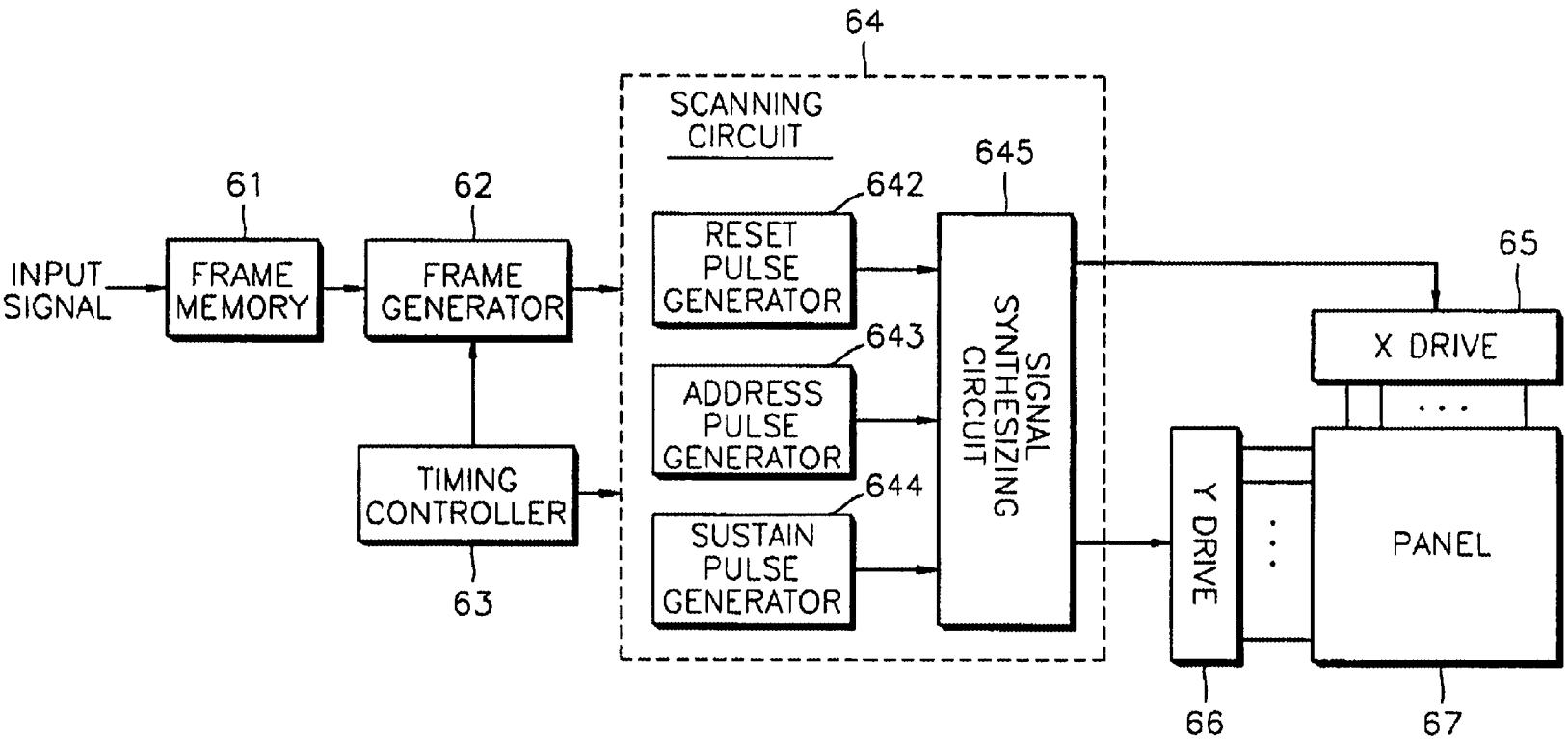
FIG. 6 is a block diagram of a preferred embodiment of a PDP driving apparatus according to the present invention.

FIG. 6 is a block diagram of a preferred embodiment of a PDP driving apparatus according to the present invention. An analog video signal to ultimately be displayed on a panel 67 is converted into digital data and stored in a frame memory 61. A frame generator 62 divides the digital data stored in the frame memory 61, when necessary, and outputs the divided digital data to a scanning circuit 64. For example, the frame generator 62 divides a single frame of pixel data stored in the frame memory 61 into a plurality of subfields according to a gray level to be displayed on the panel 67 and outputs data for each subfield.

The scanning circuit 64 scans a scan electrode (Y) drive 66 and a sustain electrode (X) drive 65 of the panel 67. The scanning circuit 64 includes a reset pulse generator 642, an address pulse generator 643, and a sustain pulse generator 644, which generate signal waveforms to be applied to electrodes in a reset period, an address period, and a sustain period, respectively. In particular, the reset pulse generator 642 generates a reset signal for initializing the state of each cell, and the address pulse generator 643 generates an address signal for discriminating cells to be turned on from cells not to be turned on and for performing an addressing operation. The sustain pulse generator 644 generates a sustain signal for discharging the cells that have been addressed by the address pulse generator 643. The scanning circuit 64 also includes a signal synthesizing circuit 645 for synthesizing the above-referenced signals and for applying the resulting synthesized signal to each electrode. A timing controller 63 generates a variety of timing signals required to operate the frame generator 62 and the scanning circuit 64.

The following description concerns operations for driving a panel according to an embodiment of the present invention, and particularly, operations during a reset period. During the other periods, the panel can be driven by a typical method, and thus a detailed description thereof will be omitted. The PDP driving apparatus of FIG. 6 is for implementing the driving method described above. However, the structure of the PDP driving apparatus of FIG. 6 should be interpreted as being capable of performing all of the operations in the embodiments of the PDP driving method according to the present invention described above.

When there is a predetermined rest period during which no discharging occurs before the application of a reset signal, the reset pulse generator 642 generates a reset stabilization signal to cause cell discharge to occur before the reset operation and then generates the reset signal (refer to FIGS. 4A and 4B).

In another embodiment, when a rest period during which no discharge in cells occurs is present in a field consisting of a reset period, an address period, and a sustain period, signals are synthesized such that the rest period is positioned between the reset period and the address period or between the address period and the sustain period, and the resulting synthesized signal is output to the panel 67 (refer to FIG. 5).

As described above, according to the present invention, reset stabilization can be achieved, even when a reset period is short, by applying discharge pulses before the reset period. As an experimental example, when a 2 msec rest period in which no sustain discharging occurs is present before a reset period, reset stabilization in the reset period can be achieved by applying ramp pulses to the sustain electrodes at a rate of 3.4V/$\mu$sec for 56 $\mu$seconds. Meanwhile, when discharges pulses are applied immediately before the reset period as in the present invention, reset stabilization can be achieved by applying ramp pulses in the reset period at a rate of 40.4V/$\mu$sec for 4.7 $\mu$seconds, even though the rest period present before the reset period may be as long as 5 msec. As a result, the length of time during which ramp pulses are applied to the sustain voltage in the reset period can be reduced sharply.

Although the preferred embodiments according to the present invention have been described with reference to an AC-type PDP, the present invention can also be applied to DC-type PDPs. In designing a panel driving timing scheme, the rest period is usually positioned in the last subfield of each frame. Thus, the present invention has been described and illustrated with reference to such a configuration. However, it will be appreciated by those skilled in the art that the PDP driving method enabling reset stabilization according to the present invention can also be applied when the rest period is in other positions in frames, in consideration of the relation between the subfield having the rest period and the following subfield. In addition, it will be appreciated by those skilled in the art that various changes in form and details may be made in the above-described embodiments of the present invention for panels that are driven in a different way from the above-described PDP, which has a frame/subfield structure, without departing from the spirit and scope of the invention as defined by the appended claims.

As described above, in the PDP driving method and apparatus according to the present invention, discharging is caused to occur between electrodes before a reset period following a rest period by performing a reset stabilization operation immediately before the reset period, or by shifting the position of the rest period. As a result, the operation in the reset period can be stabilized, and the duration of time for the reset period can be reduced.

What is claimed is:

1. A method for driving a plasma display panel in which successive field periods, each including a reset period for initializing a state of respective cells, an address period for selectively discriminating cells to be turned on from cells not to be turned on and for performing an addressing operation, and a sustain period for discharging the addressed cells, are performed, and a reset stabilization period for inducing discharging in a discharge space between cells is additionally performed before the reset period if a rest period having a predetermined time duration is present between the sustain period of a preceding field and the reset period of the field.

2. The method of claim 1, wherein, in the reset stabilization period, discharging is induced in the cells discharged in the sustain period of the preceding field.

3. The method of claim 1, wherein, in the reset stabilization period, at least one of the number of discharging occurrences, the width of discharge pulses, or the level of a discharge pulse voltage is varied depending on the duration of the rest period.

4. A method of driving a plasma display panel for displaying a picture by causing discharging in a discharge space between electrodes, in which if there is a time interval during which no discharging occurs in the discharge space before a reset period, a reset stabilization period is additionally performed before the reset period by applying a predetermined voltage to the electrodes to cause discharging between the electrodes.

5. The method of claim 4, wherein, in the reset stabilization period, discharging is induced in the cells discharged in a sustain period.

6. The method of claim 4, wherein, in the reset stabilization period, at least one of the number of discharging occurrences, the width of discharge pulses, or the level of a discharge pulse voltage is varied depending on the duration of the time interval during which no discharging occurs before the reset period.

7. A method of driving a plasma display panel in which successive field periods, each including a reset period for initializing a state of respective cells, an address period for selectively discriminating cells to be turned on from cells not to be turned on and for performing an addressing operation, and a sustain period for discharging the addressed cells, are performed, and a rest period in which no discharge in the cells occurs for a predetermined time is positioned between the reset period and the address period, between the address period and the sustain period, or in the middle of the sustain period or the address period.

8. The method of claim 7, wherein the rest period is temporally divided and then distributed in the address period or the sustain period.

9. A plasma display panel driving apparatus, comprising:

a reset signal generator for generating a reset signal initializing the state of respective cells;

an address signal generator for generating an address signal selectively discriminating cells to be turned on from cells to be turned off and for performing an addressing operation; and a sustain signal generator for generating a sustain signal discharging the cells addressed by the address signal generator, wherein if cell discharging does not occur for a predetermined time interval before application of the reset signal, the reset signal generator generates a reset stabilization signal to cause discharging to occur in the cells prior to the generation of the reset signal.

10. A plasma display panel driving apparatus comprising:

a reset signal generator for generating a reset signal initializing the state of respective cells in a reset period;

an address signal generator for generating an address signal selectively discriminating cells to be turned on from cells not to be turned on and for performing an addressing operation in an address period;

a sustain signal generator for generating a sustain signal discharging the cells addressed by the address signal generator in a sustain period; and a signal synthesizer for applying the reset signal, the address signal, and the sustain signal to electrodes, wherein if a rest period lasting for a predetermined length of time during which no cell discharging occurs is present in a field consisting of the reset period, the address period, and the sustain period, the signal synthesizer synthesizes the reset signal, the address signal, and the sustain signal such that the rest period is positioned between the reset period and the address period, between the address period and the sustain period, or in the middle of the sustain period or the address period.

11. A method of driving a plasma display panel in which a reset period for initializing the state of respective cells, an address period for selectively discriminating cells to be turned on from cells not to be turned on and for performing an addressing operation, a sustain period for discharging the addressed cells in the address period, and a reset stabilization period, if a rest period having a predetermined time duration follows the sustain period, for causing discharging in a discharge space between cells before a next reset period, are performed.

12. The method of claim 11, wherein, in the reset stabilization period, a predetermined number of reset pulses that are substantially the same as pulses applied to electrodes in the sustain period are applied.

13. The method of claim 11, wherein reset pulses applied in the reset period comprise a square pulse applied in an early stage of the reset period and a ramp pulse applied in a latter stage of the reset period with a gradually decreasing voltage level.

14. The method of claim 13, wherein, in the reset period, the reset pulses are applied to scan electrodes and a constant voltage is applied to sustain electrodes.

15. The method of claim 11, wherein reset pluses applied in the reset period comprise a first ramp pulse applied in an early stage of the reset period with a gradually increasing voltage level and a second ramp pulse applied in a latter stage of the reset period with a gradually decreasing voltage level.

* * * * *